US008939054B2

(12) United States Patent
Hawk et al.

(10) Patent No.: US 8,939,054 B2
(45) Date of Patent: Jan. 27, 2015

(54) LOCK FOR A FLIP OPEN KNIFE, AND MECHANISM FOR MAKING SAME AUTOMATIC

(75) Inventors: Grant Woodrow Hawk, Idaho City, ID (US); Gavin D. Hawk, Idaho City, ID (US)

(73) Assignee: Buck Knives, Inc., Post Falls, ID (US)

( * ) Notice: Subject to any disclaimer, the term of this patent is extended or adjusted under 35 U.S.C. 154(b) by 324 days.

(21) Appl. No.: 13/597,128

(22) Filed: Aug. 28, 2012

(65) Prior Publication Data

US 2013/0047439 A1 Feb. 28, 2013

Related U.S. Application Data

(60) Provisional application No. 61/575,802, filed on Aug. 29, 2011, provisional application No. 61/585,928, filed on Jan. 12, 2012.

(51) Int. Cl.
*B26B 1/04* (2006.01)

(52) U.S. Cl.
USPC ..... 83/13; 30/160; 30/151

(58) Field of Classification Search
USPC ..... 30/151, 158, 160, 159; 83/13
See application file for complete search history.

(56) References Cited

U.S. PATENT DOCUMENTS

| | | | | |
|---|---|---|---|---|
| 5,111,581 | A * | 5/1992 | Collins | 30/161 |
| 5,325,588 | A * | 7/1994 | Rogers | 30/161 |
| 5,769,094 | A * | 6/1998 | Jenkins et al. | 30/161 |
| 6,463,663 | B1 * | 10/2002 | Kanzawa | 30/160 |
| 6,836,967 | B1 * | 1/2005 | Sakai | 30/161 |
| 6,941,661 | B2 * | 9/2005 | Frazer | 30/160 |
| 6,968,622 | B2 * | 11/2005 | Ping | 30/156 |
| 7,080,457 | B2 * | 7/2006 | Sullivan | 30/160 |
| 7,284,329 | B1 * | 10/2007 | King | 30/161 |
| 7,395,599 | B2 * | 7/2008 | Onion | 30/159 |
| 7,578,064 | B2 * | 8/2009 | Busse | 30/153 |
| 2003/0009886 | A1 * | 1/2003 | Onion | 30/161 |
| 2004/0261272 | A1 * | 12/2004 | Moser | 30/160 |
| 2005/0241154 | A1 * | 11/2005 | Lake | 30/160 |
| 2008/0307656 | A1 * | 12/2008 | Lin | 30/159 |
| 2013/0133205 | A1 * | 5/2013 | Lo | 30/160 |

* cited by examiner

*Primary Examiner* — Sean Michalski
(74) *Attorney, Agent, or Firm* — Kilpatrick Townsend & Stockton LLP

(57) ABSTRACT

An improvement of a folding knife locking mechanism with an adjustable wedge to remove blade slop. The present mechanism allows for smooth opening and closing of the blade by limiting friction against the blade as it rotates. This knife has a bearing system for low friction blade rotation. Also the leaf strap lock is arranged so that it only comes into contact with the blade at the start of opening and at the end of opening, further limiting the friction forces against the blade. Provided is also an adjustment wedge to remove blade lock slop. In the manufacturing process loose tolerances can be adjusted out using the adjustment wedge. Normal use wear against the stop pins and handles can cause some looseness of the blade which can also be removed by the adjustment wedge.

29 Claims, 17 Drawing Sheets

FIG. 10A
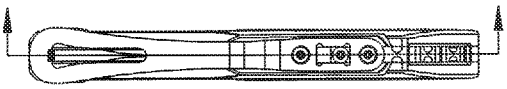
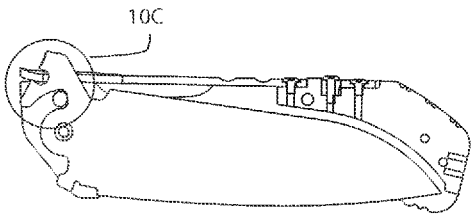
FIG. 10B
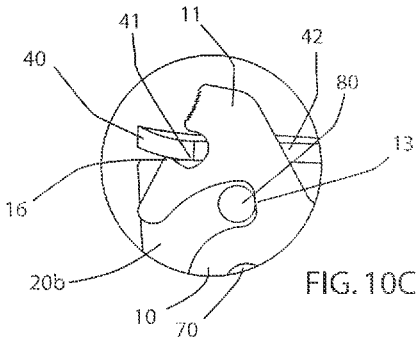
FIG. 10C
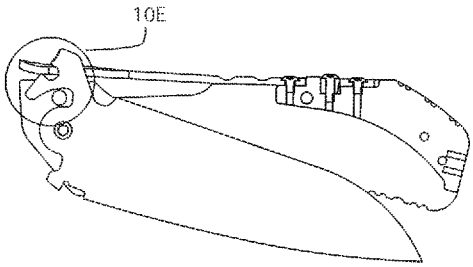
FIG. 10D
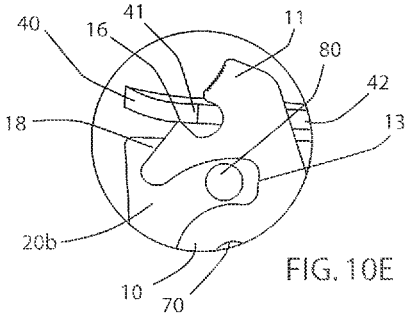
FIG. 10E
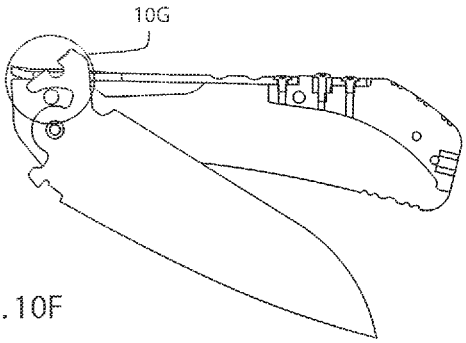
FIG. 10F
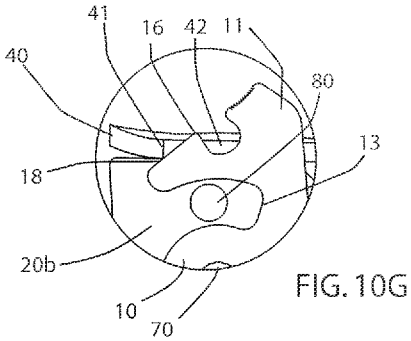
FIG. 10G FIG. 15A
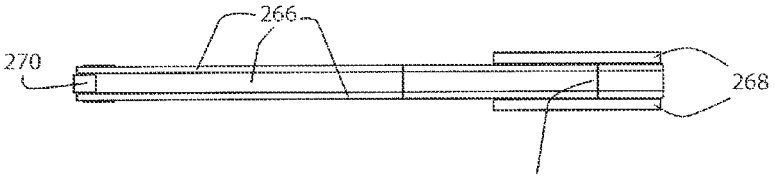
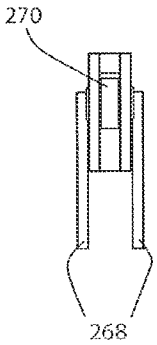
FIG. 15B
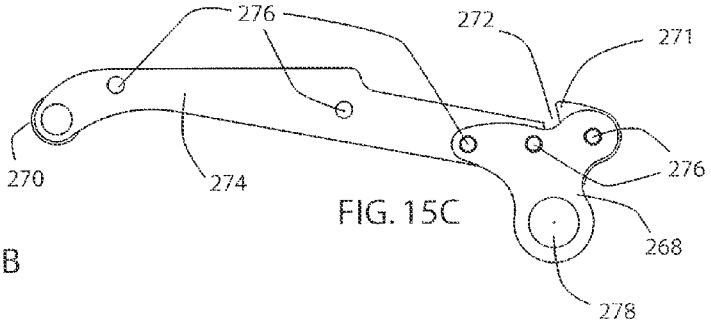
FIG. 15C
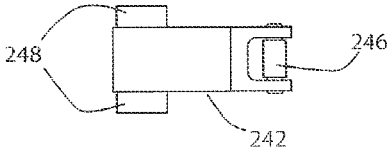
FIG. 16A
FIG. 16B
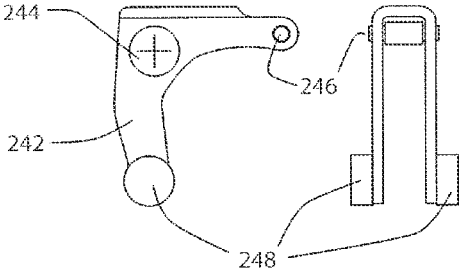
FIG. 16C
FIG. 17B
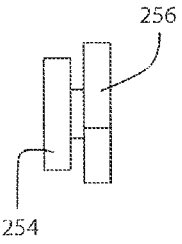
FIG. 17A
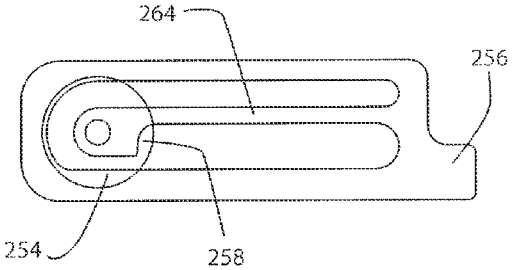

LOCK FOR A FLIP OPEN KNIFE, AND MECHANISM FOR MAKING SAME AUTOMATIC

CROSS-REFERENCES TO RELATED APPLICATIONS

The present application claims the benefit of U.S. Provisional Application No. 61/575,802 , filed on Aug. 29, 2011, and U.S. Provisional Application No. 61/585,928, filed on Jan. 12, 2012, the full disclosures of which are incorporated herein by reference.

FIELD OF THE INVENTION

The present disclosure relates to folding knives, and particularly to a method of profiling the level of force deployed in opening of a flip open blade as well as an adjustable lock to compensate for wear.

BACKGROUND

Folding knives with a lock mechanism to keep the blade open are well known. Typically these knives have a spring actuated lock that rests either on the side of the blade or on the blade tang as the blade rotates. This positioning of the lock, and its constant contact with the blade or tang during rotation, causes friction so that blade rotation is constantly subject to drag. Also, when the blade has been in use, the strap lock interface and locking surfaces wear and the blade develops some slop or lock wiggle. This makes for a low quality knife and unsafe conditions.

A very popular design for modern folding knives is a configuration that allows for the blade to be opened by exerting pressure on a spur of the tang, protruding above the handle frame. This spur is often called a "flipper". These knives are commonly called "Flipper Knives" and most variations rely on a locking mechanism based on the liner lock. Liner locks are well known, and an example can be found in U.S. Pat. No. 825,093 to Watson. The disadvantage of using a liner lock, in conjunction with this opening method, is that the liner lock is in continuous contact with the blade tang when the knife rotates, which generates an unacceptable level of drag on the opening blade. Folding knives of this design are difficult to open and prone to misfire, requiring an enhanced level of dexterity by the operator.

Automatic opening knives are well known in the prior art, encompassing a wide variety of features. The so-called double action configuration allows the user the option of either opening the blade in the usual automatic mode, of depressing the firing pin, or conversely, simply opening the blade with the thumb or other hand.

Most automatic opening knives are provided with a separate safety switch intended to prevent accidental firing and a very few combine the safety and the firing pin within the same button, which may be shifted in an alternate plane of motion, to engage or disengage the safety feature before firing.

The basic configuration of the blade lock, as disclosed herein, has much in common with automatic knives developed in Italy during the nineteenth century. The Italian design, herein referred to as a strap lock, relies on a flat spring affixed to the spine of the handle frame near the butt of the handle and resiliently capturing a protrusion on the blade tang to cause lock up when opened. The disadvantage of the Italian design is lack of a means to compensate for strap lock wear and it's incompatibility with modern flipper opening methods, due to the fact that the flipper spur must pass through the area occupied by the strap lock.

Prior art patents are as follows: US 462,141, U.S. Pat. No. 1,263,440, and U.S. Pat. No. 5,095,624.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to providing a knife with a locking mechanism with an adjustable wedge to remove blade slop. In the manufacturing process loose tolerances can be adjusted out using the adjustment wedge, thereby avoiding the necessity for precision parts. Normal use of the knife can cause some wear between the stop pin and handles, as well as the lock interface, leading to some looseness of the connection of the blade and lock. This looseness, or slop, can also be removed by the adjustment wedge.

In accordance with additional embodiments, the present mechanism allows for smooth opening and closing of the blade by limiting friction against the blade as it rotates. Typically, locking folding knives have some frictional forces against the blade, be it a ball detent or washers. In contrast, embodiments herein provide a bearing system for low friction blade rotation.

Also, in accordance with further embodiments, a strap lock for the blade is arranged so that the strap lock comes into contact with the blade only at the start of opening and at the end of opening. This feature further limits friction forces against the blade. Thus, unlike many prior art knives, the locking mechanism of the knife does not contact the blade during the majority of the blade's rotation from closed to opened In accordance with aspects herein, a closely controlled level of resistance is provided at the beginning of the opening cycle, so that when sufficient force is supplied by a user to overcome this resistance and the resistance is overcome, the force the user is supplying to the blade is sufficient to propel the blade fully to open and lock without fail.

Features herein also provide for an automatic opening knife that includes the double action option of opening, either manually by thumb pressure against a blade mounted stud or hole, or automatically by manipulating a firing switch. Embodiments utilize one or more of a safety that is integral to the firing switch, a lock that is adjustable to compensate for lock wear, a main spring that is adjustable for power output, as well as the added feature of both ambidextrous opening and ambidextrous delocking, although other features may be used.

For a fuller understanding of the nature and advantages of the present invention, reference should be made to the ensuing detailed description and accompanying drawings.

BRIEF DESCRIPTION OF THE DRAWINGS

FIGS. 15A-C show a thrust arm assembly for the automatic opener of the knife of FIG. 12, with the three figures showing three different views.

FIGS. 16A-C show two different views of a rocking sear for the automatic opener of the knife of FIG. 12.

FIGS. 17A and 17B show two views of a trigger slide for the knife of FIG. 12.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1A:
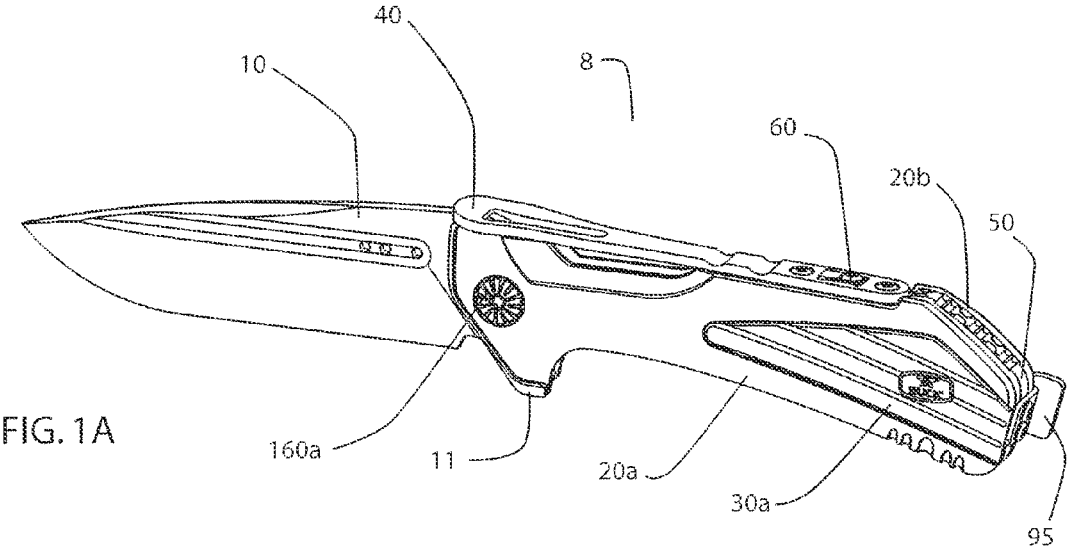
FIG. 1A is a front perspective view of a folding knife in accordance with embodiments, with the blade of the folding knife open.
Figure 1B:
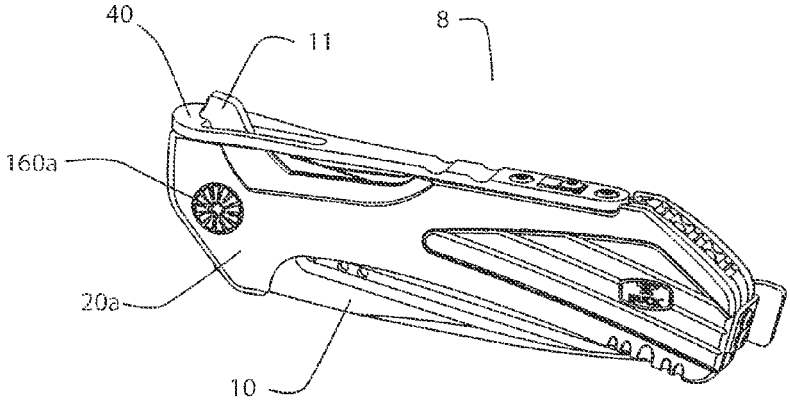
FIG. 1B is a front perspective view of the folding knife of FIG. 1, with the blade closed.

FIG. 1A-1B shows a folding knife 8 in accordance with embodiments. The knife 8 has left and right handles 20*a* and 20*b* which provide safe storage for the blade 10 when closed (FIG. 1B). Although the two side pieces of the knife structure are referred to herein as "handles" 20*a* and 20*b*, as used herein, "handle" is any structure of the knife that is designed to be held by a user, and may or may not include a handle frame or other pieces of the knife body, but typically not the blade 10. The blade 10 rotates around a pivot pin 70 (FIG. 2) from the storage area between the handles 20*a* and 20*b* (FIG. 1B) to an open, ready-for-use position (FIG. 1A).

Figure 3A:
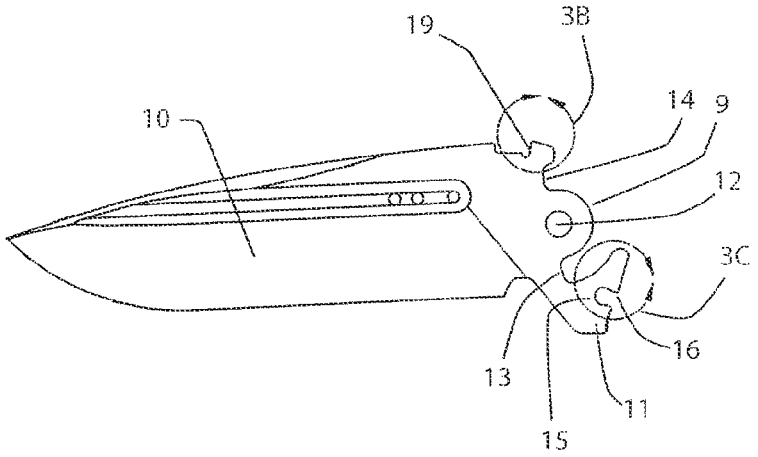
FIG. 3A is a left plan view of a knife blade for the knife of FIG. 1.

As shown in FIG. 3A, the blade 10 includes a tang 9 at a proximal end. The tang 9 of the blade 10 has a hole 12 for the pivot pin 70.

A radial arc is formed about the proximal end of the tang 9. This arc includes a stop 13 at a lower, blade side of the tang, and a stop 14 at the opposite end of the arc, or at a top of the blade. The stop 13 engages a pin 80 (FIG. 10C) and provides a rest when the blade 10 is in the closed position and prevents over-rotation of the blade. The stop 14 engages the pin 80 (FIG. 10O) for preventing over-rotation when the blade 10 is in the open position.

Figure 3B:
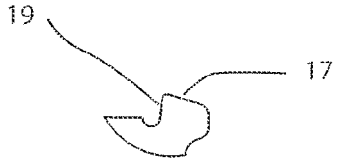
FIG. 3B is a detail view 3B of FIG. 3A, showing a blade lock notch for the knife of FIG. 1.
Figure 3C:
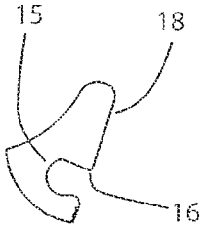
FIG. 3C is a detail view 3C of FIG. 3A, showing a blade closed detent notch for the knife of FIG. 1.

As best shown in FIGS. 3A-3C, the bottom edge of the tang 9 includes a flipper 11 and a detent extension 16. The detent extension 16 includes a cam surface, or ramp 18 along a proximal edge. A tab notch, or tab 15 is located just below the flipper 11, and between the flipper 11 and the detent extension 16. As described in more detail below, the flipper 11 is a protrusion of the tang 9 used for opening the blade. A ramp 17 is located on the opposite side of the tang 9 from the flipper 11. A lock notch 19 is located just below the ramp 17.

Figure 10H:
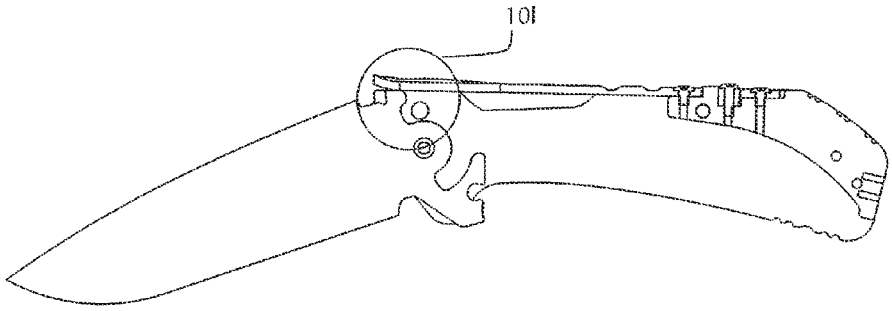
FIGS. 10A-10O are a sequence view and detail views showing the blade detent and blade lock engagement of the strap lock moving from the closed to open locking position.
Figure 10I:
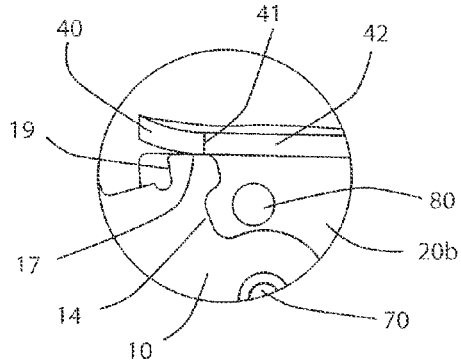
Figure 10J:
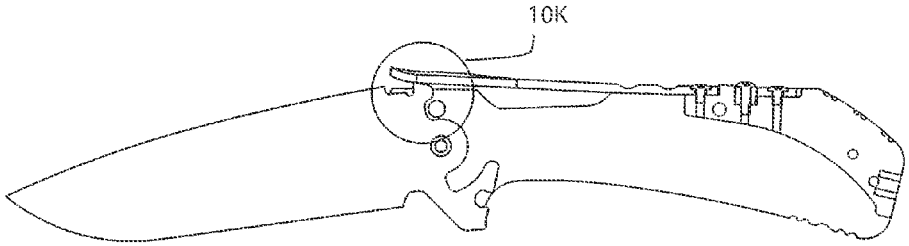
Figure 10K:
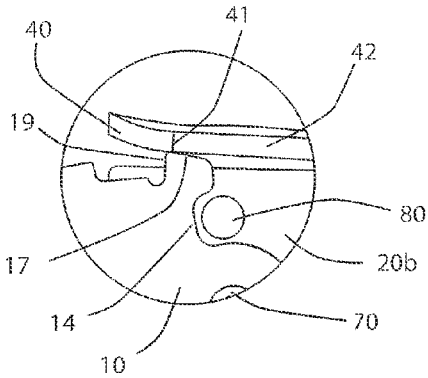
Figure 10L:
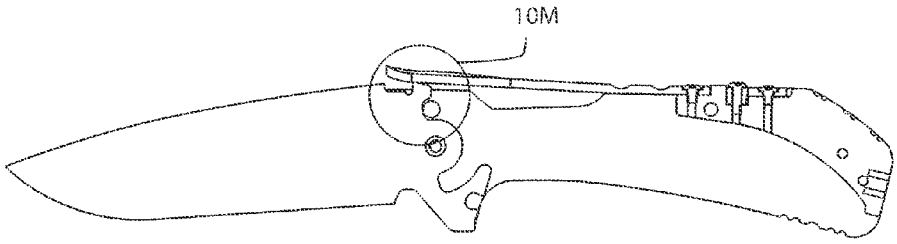
Figure 10M:
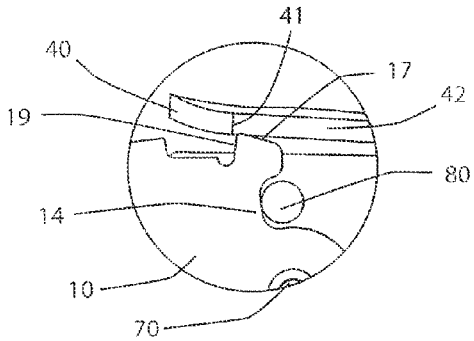
Figure 10N:
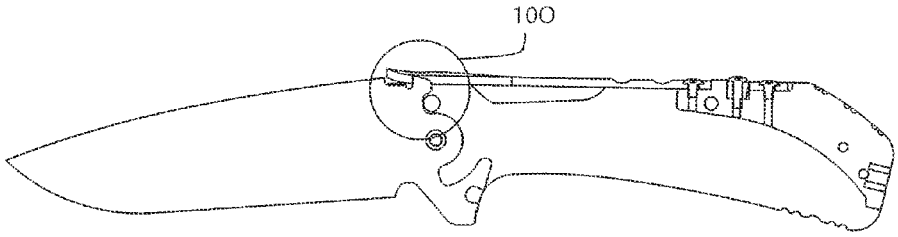

FIG. 3B shows a detail view of the lock notch 19 which fully engages the slot 42 in the strap lock 40 when the blade is in the open position (FIGS. 10M and 10N). The lock notch 19 is part of the lock notch and ramp 17. FIG. 3C is a detail view of the closed position detent extension 16 and a ramp 18, which engage the slot 42 in the strap lock 40 when the blade is closed (e.g., FIG. 10C), as described below.

Figure 6A:
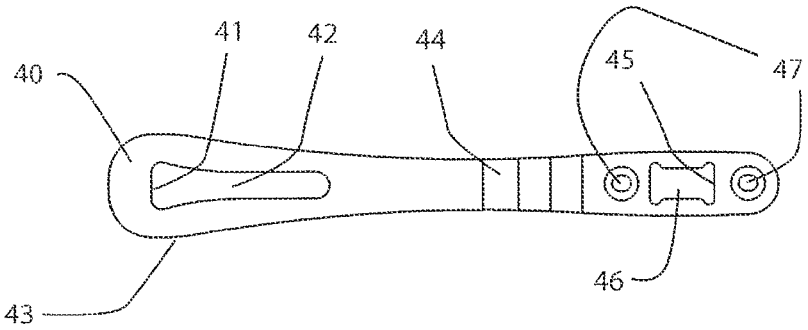
FIG. 6A is a top view of a strap lock for the knife of FIG. 1.

The strap lock 40 is provided on the back of the knife 8. The proximal end (right in FIG. 6A) of the strap lock 40 is fixed to the top of the knife by an adjustment wedge 60 and a spacer element 50, both of which are described in more detail below.

The strap lock 40 is flexible, yet resilient, so that a distal end (left in FIG. 6A) can bend away from the top edge of the knife 8. To this end, the strap lock 40 is formed of a flexible, yet resilient material that biases towards a straight configuration (towards the handle), yet is flexible enough to move away from the handle upon the application of sufficient force, for example by a user pulling upward. To aid in bending of the strap lock 40, a relief 44 can be provided to allow more flexible bending of the strap lock 40 in the region of the relief.

To aid in moving the distal end of the strap lock 40 upward, a thumb ridge 43 can be provided for a user to engage with a thumb to move the strap lock 40 upward. In addition, the strap lock 40 can be wider than the handle, with overlapping outer edges of the strap lock providing a gripping surface for a user to grasp the strap lock and pull upward.

Figure 6B:
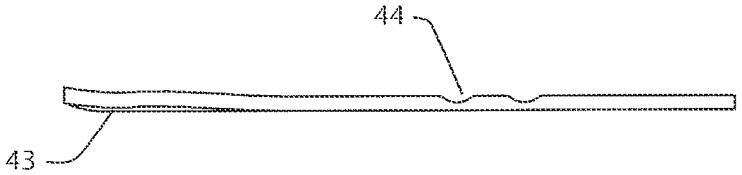
FIG. 6B is a left view of the strap lock.
Figure 6C:
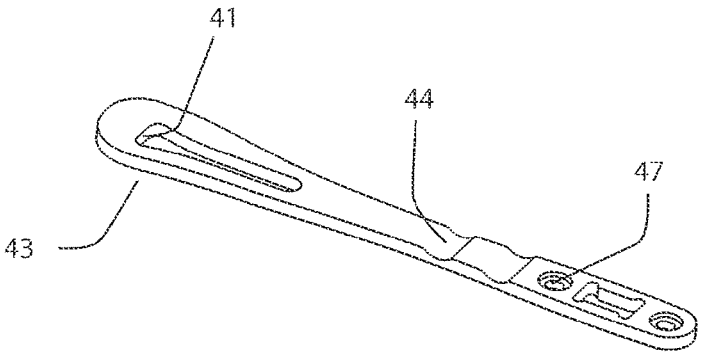
FIG. 6C is a front perspective view of the strap lock.

The strap lock 40 includes a slot 42 (FIG. 6A) for the blade flipper 11 to pass thru (see FIG. 1B). FIG. 6B shows the side view of the arm and FIG. 6C shows a perspective view. The slot 42 includes a lock engagement surface 41 (FIG. 6A) at a distal, inner edge. The strap lock 40 includes a second slot 46 to receive the spacer 50. A proximal side of the slot 46 includes a strap lock interface 45 along an inner, proximal edge. As described below, the strap lock interface 45 is engaged by a slanted proximal edge of the wedge 60 as the wedge is tightened down to adjust position of the strap lock 40. Holes 47 are positioned on opposite sides of the slot 46 to receive fasteners 141 (FIG. 2) that fasten the strap lock 40 to the spacer 50.

Figure 2:
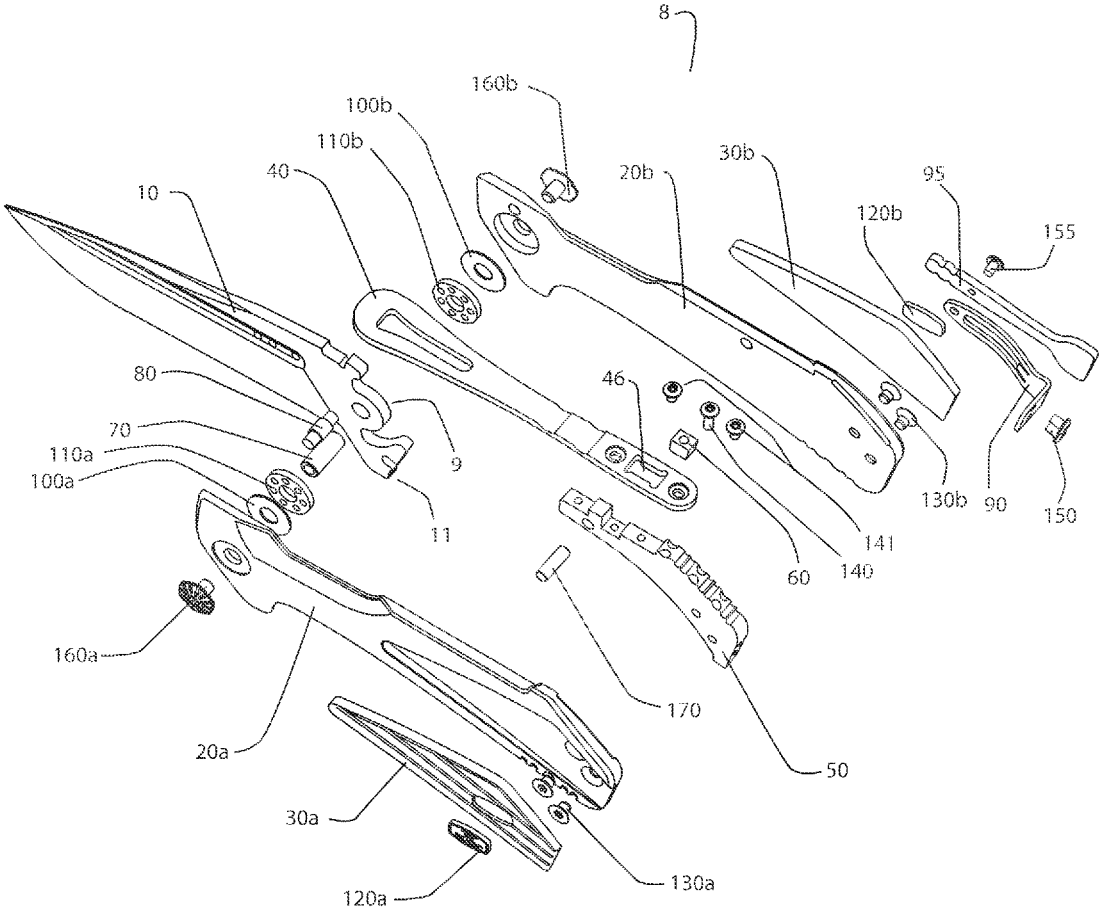
FIG. 2 is an exploded view of the knife of FIG. 1.

FIG. 2 shows an exploded view of the knife 8. The blade 10 is fastened to the handles 20*a* and 20*b* between washers 100*a* and 100*b* and bearings 110*a* and 110*b* by the pivot pin 70. The washers 100*a* and 100*b* and bearings 110*a* and 110*b* provide smooth travel of the blade 10 between closed and opened positions. The pivot pin 70 also fastens the handles 20*a* and 20*b* and is secured by screws 160*a* and 160*b*.

Figure 4A:
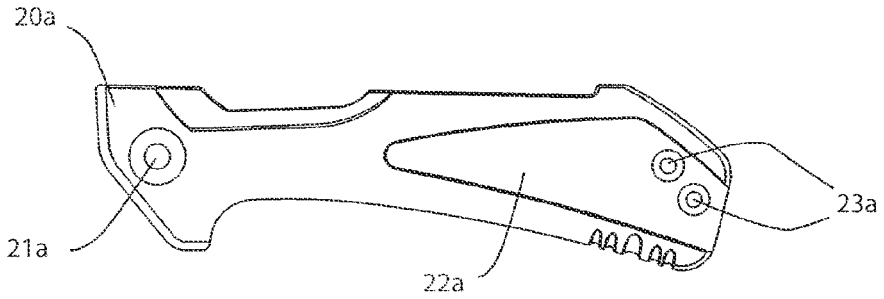
FIG. 4A is a left plan view of a left handle for the knife of FIG. 1.
Figure 4B:
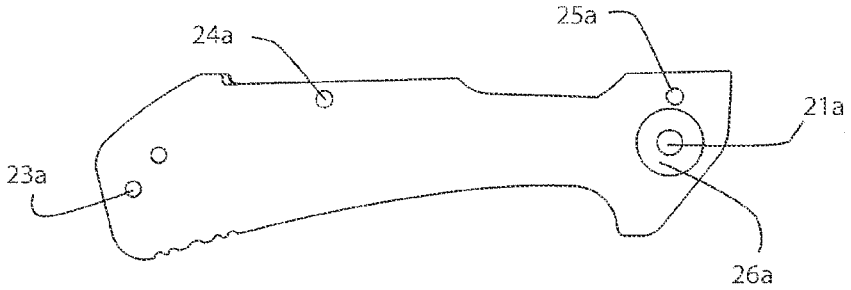
FIG. 4B is a right plan view of the left handle.

FIG. 4A shows the left handle 20*a*. A hole 21*a* is provided to secure the pivot pin 70. Holes 23*a* are provided to secure a spacer 50 (FIG. 2). A pocket 22*a* is provided for the inlay 30*a*. FIG. 4B shows back face of the left handle 20*a*. A hole 24*a* (FIG. 4B) is provided for the spacer pin 170, and a hole 25*a* is provided for the stop pin 80. A recess 26*a* is provided for the bearings 110. The right handle 20*b* is a mirror of the left handle 20*a*.

Figure 7A:
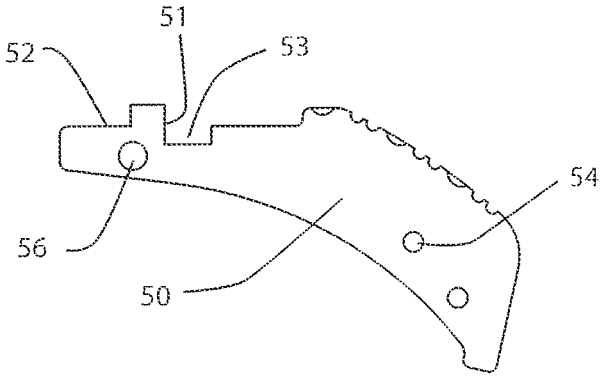
FIG. 7A is a left plan view of a spacer for the knife of FIG. 1.
Figure 7B:
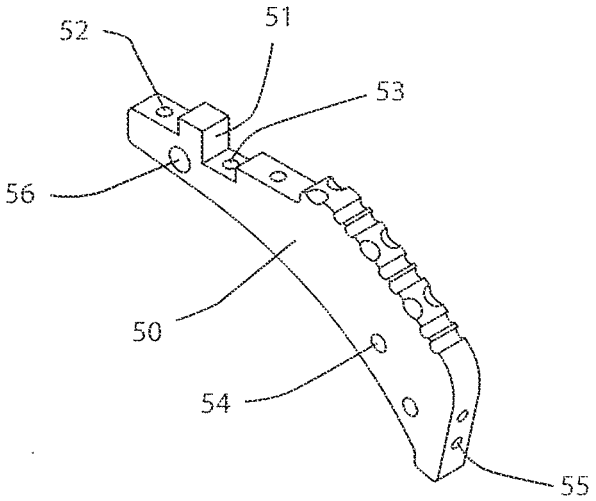
FIG. 7B is a front perspective view of the spacer.

FIG. 7A shows a side view of the spacer 50, and FIG. 7B shows a perspective view. The spacer 50 fits between the proximal ends of the handles 20*a* and 20*b*, and properly spaces the handle so that the blade 10 may fit between the handles. The spacer 50 includes a hole 56 for the spacer pin 170, holes 54 for the fastening screws 130*a* and 130*b*, holes 52 to fasten to the strap lock 40, and an adjustment wedge interface 51 to receive the adjustment wedge 60. A hole 53 is provided to secure the adjustment wedge 60. Holes 55 are provided to secure a belt clip 90.

The handles 20*a* and 20*b* are fastened to the spacer 50 by screws 130*a* and 130*b*. The strap lock 40 is fastened to the spacer 50 by the screws 141. The stop pin 80 is held between the handles 20*a* and 20*b*. A belt clip 90 is provided and secured by screws 150 to the spacer 50. The adjustment wedge 60 is fastened to the spacer 50 by a screw 140. Decorative handle inlays 30*a* and 30*b* are provided here also.

Figure 8A:
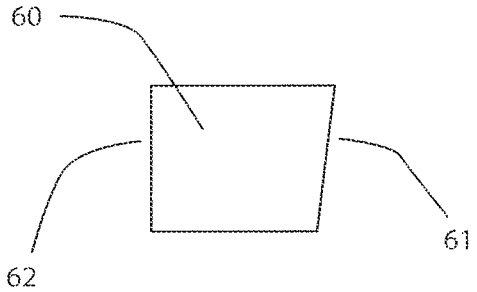
FIG. 8A is a left plan view of an adjustment wedge for the knife of FIG. 1.
Figure 8B:
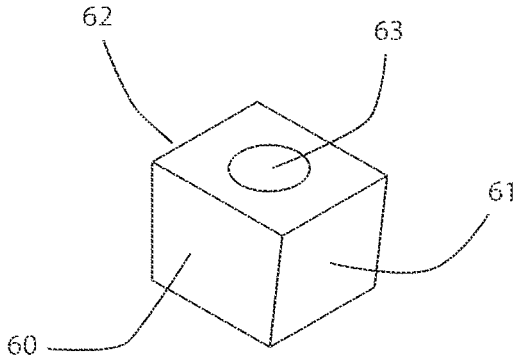
FIG. 8B is a front perspective of the adjustment wedge.

FIG. 8A shows a side view of the adjustment wedge 60. FIG. 8B shows a perspective view. The adjustment wedge includes a upright surface 62 on a distal side, and an angle surface 61 on the opposite, proximal side. A hole 63 extends through the adjustment wedge 60 to receive a screw 140 to secure the adjustment wedge to the spacer 50.

Figure 9A:
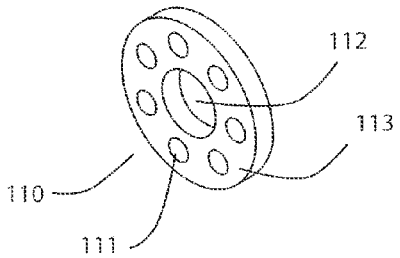
FIG. 9A is a front perspective view of a bearing race for the knife of FIG. 1.

FIG. 9A is a perspective view of the bearings 110.

Figure 9B:
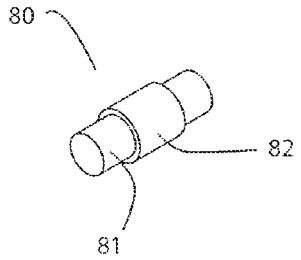
FIG. 9B is a front perspective view of a stop pin for the knife of FIG. 1.

FIG. 9B shows a perspective of the stop pin 80.

Figure 9C:
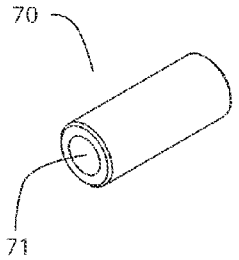
FIG. 9C is a front perspective view of a pivot pin for the knife of FIG. 1.

FIG. 9C shows a perspective of the pivot pin 70.

Figure 9D:
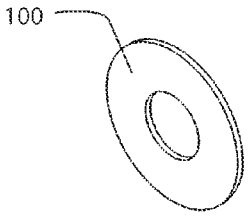
FIG. 9D is a front perspective view of a bearing washer for the knife of FIG. 1.

FIG. 9D shows a perspective of the bearing washer 100.

Figure 5:
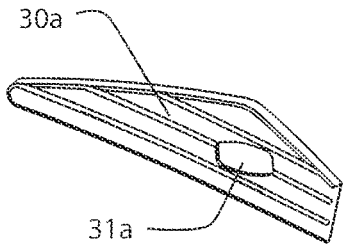
FIG. 5 is a front perspective view of the left handle inlay for the knife of FIG. 1.

FIG. 5 shows the handle inlay 30*a* and pocket 31*a* for a logo.

Description of the Opening Operation of the Knife:

FIGS. 1B and 10A show the knife 9 in the stored position. The blade 10 is in the closed position between the handles 20*a* and 20*b*. FIG. 10B is a section view of the blade in the closed position. FIG. 10C shows a detail view of the connection of the blade 10 to the strap lock 40. The strap lock 40 is biased down toward the pivot 70 by the resilience and bias of the material used for the strap lock 40. The detent extension 16, via the cam notch 15, is in contact with a bottom of the strap lock 40, and is pressed downward by the strap lock 40.

In this closed position, the tab notch 15 fits around the lock engagement surface 41 of the slot 42 on the strap lock 40. The bias and resilience of the spring arm 40 pushes down on the lower, inside edge of the tab notch 15, causing the blade 10 to be pushed more toward the closed position, preventing accidental or unintentional opening of the blade 10. The blade 10 is stopped from rotating further into the handle by the stop 13 engaging the stop pin 80.

When a user wishes to open the blade 10 to the ready for use position, the user pulls back on the outer, exposed protrusion of the flipper 11 (the exposed portion of the flipper in FIG. 10C) with the index finger while gripping the handles 20*a* and 20*b* with the thumb (one handle 20*b*) and the other three fingers of the hand (other handle 20*a*).

FIG. 10D shows the section view of the blade 10 as the user starts to pulls back on the flipper 11 with the index finger, starting the opening of the blade 10. FIG. 10E shows a detail view of engagement of the tab notch 15 with the strap lock 40. As the flipper 11 is pulled back by the user, the detent extension 16 rotates up against the strap lock 40, bending the strap lock upwards. The strap lock 40 flexes upward while the leaf spring action of the material in the strap lock pushes back. The relief area aids in flexibility and the leaf spring effect of the strap lock. This resistance to bending is overcome by the application of sufficient pulling force on the flipper 11 by the user.

FIG. 10F is a section view of the blade 10 opening further. FIG. 10G shows a detail view of the strap lock 40 in contact with the detent extension 16. As shown in FIG. 10G, as the blade is further rotated open, the ramp 18 of the detent 16 pushes against the strap lock 40 on the strap lock interface 41, pushing up on the strap lock 40, eventually with the ramp 18 sliding over the lock engagement surface 41 and passing thru the slot 42, allowing free rotation of the blade 10 as the ramp no longer engages the strap lock 40.

The amount of pressure applied by a user to rotate the ramp 18 over the lock engagement surface 41 builds until sufficient to overcome the resiliency and spring tension of the strap lock 40. This pressure/force, when the engagement releases, creates rotational inertia for the blade 10 when the engagement surface eventually rolls over the lock engagement surface 41. This inertia causes the blade 10 to rotate fully to the open position and snap into locked engagement.

FIG. 10H shows a section view of the blade 10 almost fully open. FIG. 10I shows a detail view of the engagement of the blade 10 and the strap lock 40. The lock ramp 17 is in contact with the strap lock 40.

FIG. 10J shows a section view of the blade 10 opening further. FIG. 10K shows a detail view. As the blade 10 rotates more, the ramp 17 eventually engages and pushes up on the strap lock 40. Due to the inertia of the blade (discussed earlier), this action typically occurs through momentum of the blade rotation upon release from the lock engagement surface 41. Thus, the momentum of the blade is sufficient not only to rotate the blade fully open, but to provide enough force to move the strap lock 40 upward via engagement by the ramp 17. If the momentum is not sufficient, a user may grip and further rotate the blade 10 to the fully opened position. A user can, with proper quick and steady application of pressure to the flipper 11, build sufficient pressure through the flipper to rotate the blade over the ramp 18, providing sufficient pressure and ultimately blade inertia to cause the blade to rotate freely about the pivot 70 and momentum sufficient to cause the ramp 17 to engage and push out and lock into the distal end of the strap lock 40. The pressure/force buildup caused by the resistant of the ramp 18 to sliding over the lock engagement surface 41 at the beginning of the opening process causes this action to naturally occur. So unlike prior art flipper knives, this action occurs almost automatically, instead of requiring a lot of practice by a user.

FIG. 10L shows a section view of the blade fully open. FIG. 10M shows a detail view of the blade 10 in contact with the strap lock 40. When fully opened, the blade is locked in the open position by the slot 42 in the strap lock 40 fitting around the blade lock notch 19 on the proximal end of the rear of the blade 10. The blade 10 is stopped from further opening by the stop 14 engaging the stop pin 80. The blade lock notch 19 is in contact with strap lock interface 41. The ramp 17 is passed in to the slot 42. The knife is ready for use.

Figure 10O:
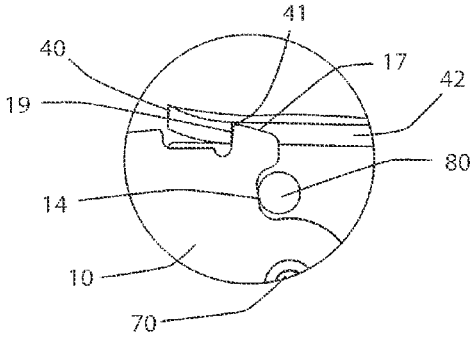

FIG. 10N shows a section view of the blade 10 fully open. FIG. 10O shows a detail view of engagement of the blade 10 with the strap lock 40. The strap lock 40 is biased down toward the pivot 70. As described above, the blade 10 rotates, either freely or by a user pulling the blade, until the ramp 17 engages the strap lock 40, in sequence first pressing it upward and passing into the slot 42, permitting the strap lock 40 to freely move back downward. At the end of this movement, the strap lock interface 41 pushes down on and fits behind the blade lock notch 19. The downward force of the strap lock 40 causes the blade 10 to rotate further open and locks the stop 14 against the stop pin 80. This prevents the blade 10 from closing and makes a tight lockup without blade slop.

The knife is returned to the storage position is as follows: The user pushes upward on the strap lock 40 unlocking the ramp 17 on the blade 10 from the slot 42 in the strap lock 40. The user may pull back on the strap lock 40, for example by gripping either side of the strap lock at opposite sides of the thumb ridge 43, or by pushing up on the thumb ridge 43 with a thumb. The user then pushes down on the top of the blade 10, rotating the blade 10 back to the stored position. The flipper 11 fits into the slot 42 in the strap lock 40 and the engagement of the lock engagement surface 41 with the inside of the latch 15 holds the blade closed against the strap lock 40. The knife is stored.

Figure 11A:
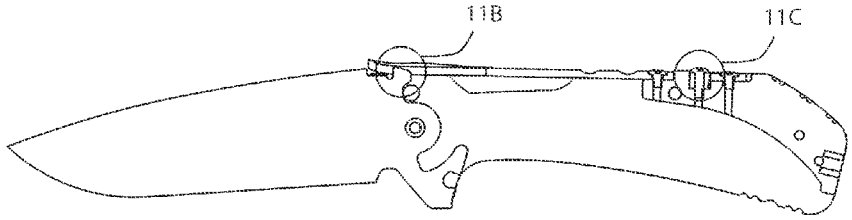
FIGS. 11A-11C are views and detail views showing the adjustment wedge fully adjusted to minimize blade slop at the blade notch end.
Figure 11B:
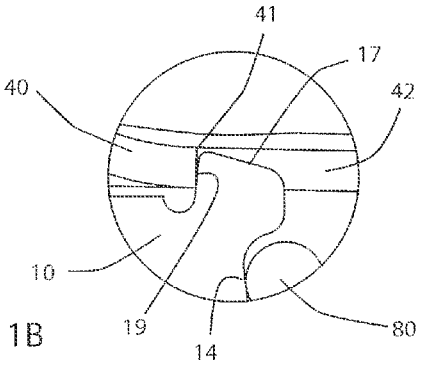
Figure 11C:
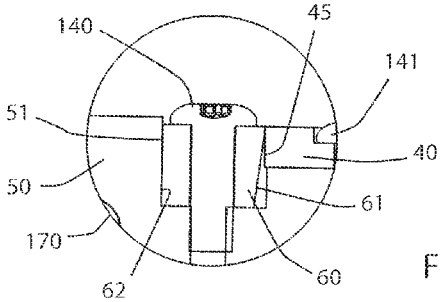

A precise fit of the blade lock notch 19 with the strap lock interface 41 prevents slop in the blade when locked in the open position. Over multiple openings and closings of the blade 10, the blade lock notch 19 and/or the strap lock interface 41 may slightly wear, permitting some slop in the locked-open blade. To prevent such slop, the adjustment wedge 60 permits movement, tightening, and locking of the strap lock 40 to a position where the blade lock notch 19 precisely fits against the strap lock interface 41. FIG. 11A shows a section view of the assembly with the adjustment wedge 60 fully engaged when the adjustment screw 140 is rotated clockwise. FIG. 11C shows a detail view. The adjustment wedge 60 is in place so that surface 62 is in contact with spacer stop surface 51 and the angled wedge edge 61 has maximum contact with strap lock interface 45 (FIG. 11F).

Tightening the screw 140 causes the angled wedge edge 61 to cam against the strap lock interface 45, forcing the strap lock 40 back away from the pivot toward the tang end of the handle. Leaf spring screws 141 are loosened and tightened to allow the strap lock 40 to slide and then be secured to the spacer 50. These screws 141 are loosened with the blade in the locked, opened position, and then the screw 140 is tightened until the strap lock 40 cannot move back further. The screws 141 are then tightened to prevent further movement of the strap lock 40. With the adjustment wedge 60 fully tightened by the screw 140, the maximum amount of blade slop can be removed. FIG. 11B shows the blade lock notch end 19 in full contact with the strap lock interface 41. This forces the blade stop 14 further open against the stop pin 80, removing blade slop.

Figure 11D:
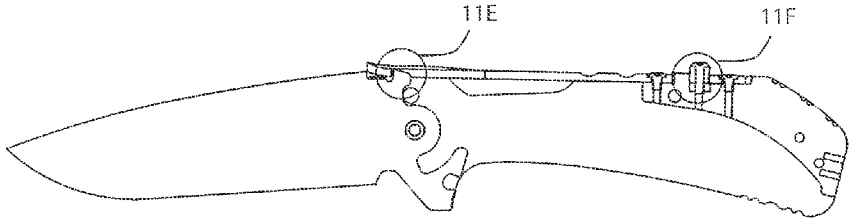
FIGS. 11D-11F are views and detail views showing the adjustment wedge minimally adjusted allowing more blade slop at the blade notch end.

FIG. 11D shows a section view of the assembly with the adjustment wedge 60 fully disengaged when the adjustment screw 140 is rotated counterclockwise. FIG. 11F shows a detail view. The adjustment wedge 60 is up so that surface 62 is in contact with spacer stop surface 51 and the angled wedge edge 61 has minimal contact with the adjustment wedge interface 45. This forces the strap lock 40 fully forward toward the pivot. Leaf spring screws 141 are loosened and tightened to allow the strap lock 40 to slide and secure it to the spacer 50. With the adjustment wedge 60 in this position fully disengaged the blade has maximum slop.

Figure 11E:
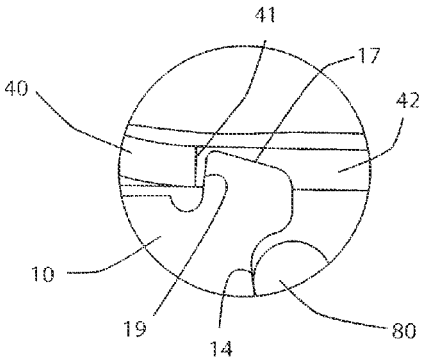
Figure 11F:
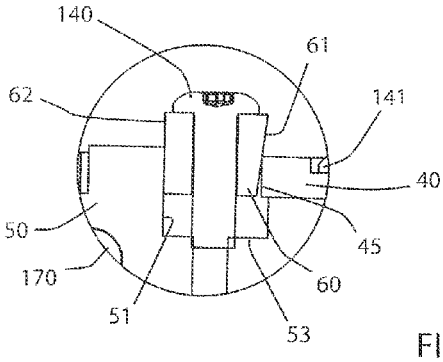

FIG. 11E shows the blade lock notch end 19 not in contact with the strap lock interface 41. This allows blade slop between the blade stop 14 against the stop pin 80 and blade lock notch end 19 spaced away from strap lock interface 41.

Figure 12:
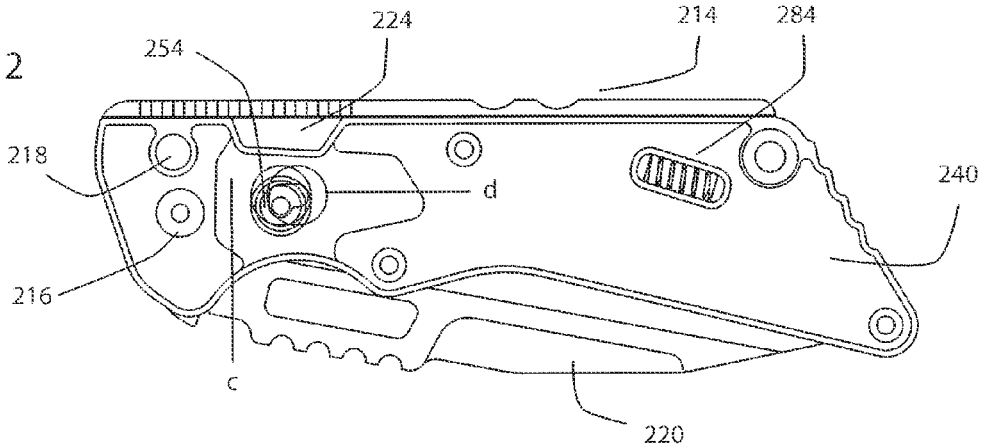
FIG. 12 shows an additional embodiment of a folding knife including an automatic opener, and shown in a fully assembled, closed position

FIG. 12 shows an additional embodiment including some of the previously described features, and additionally including an automatic opener. Briefly described, the knife of FIG. 12 includes a trigger button 254 that can be manipulated by a user to automatically open the knife. The trigger button is designed for two motions, one of which unlocks the automatic opener and another of which actuates the automatic opener. When trigger button 254 is lifted by thumb pressure in direction of arrow c, FIG. 22, the thumb may then pull trigger button 254 rearward in the direction of arrow d. This motion causes the automatic opener to fire, which rotates the blade 210 to overcome the resistance of the strap lock 40 (described above).

Figure 13:
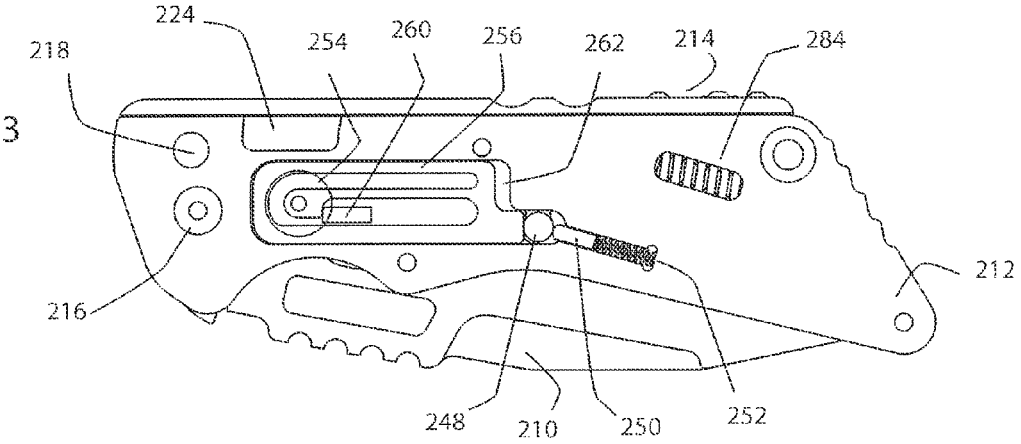
FIG. 13 shows same view as FIG. 12 with handle overlay removed.
Figure 18:
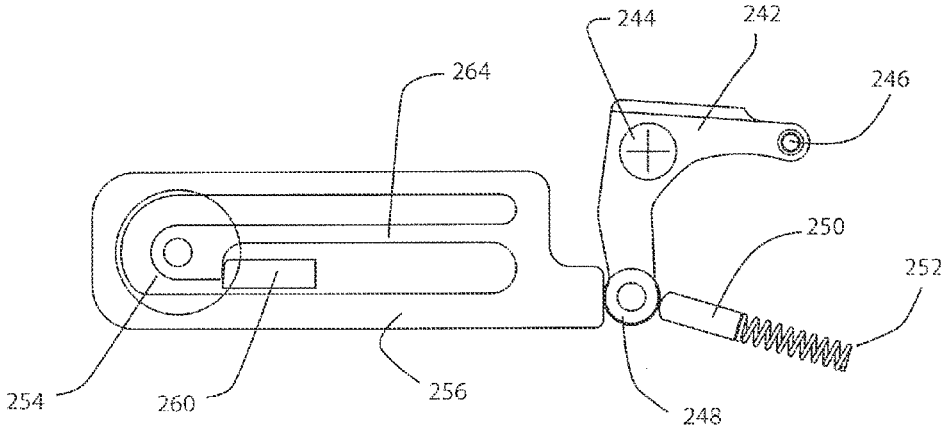
FIG. 18 shows a trigger slide for the knife of FIG. 12, with the trigger slide in a safe position.
Figure 19:
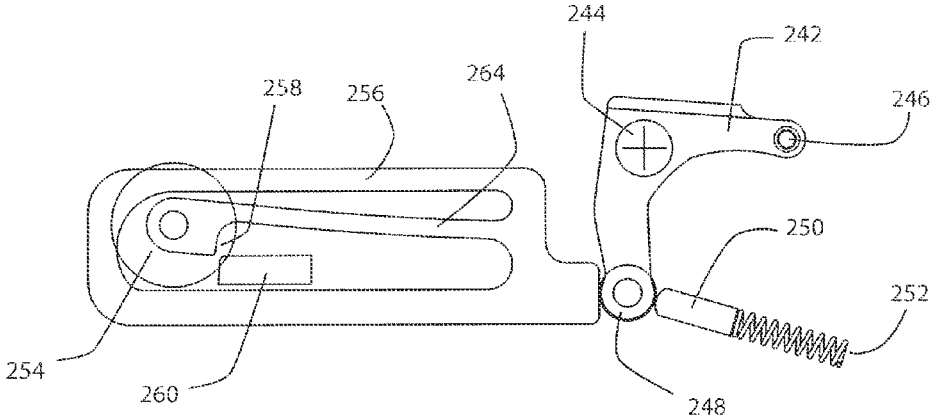
FIG. 19 shows the trigger slide in shows the trigger slide of FIG. 18 with a trigger switch displaced in preparation for firing.
Figure 20:
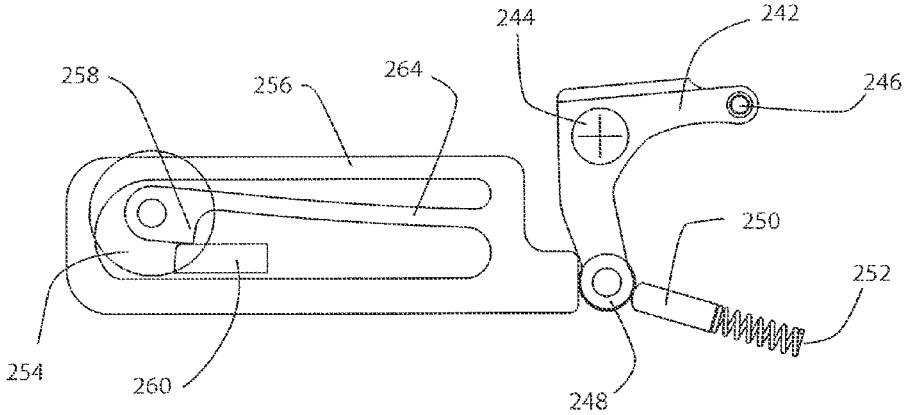
FIG. 20 shows the trigger slide at the end of a firing cycle.

Details of the trigger mechanism can be seen in FIGS. 13, and 17-20. The trigger mechanism includes the trigger button 254, which is mounted on the end of a flexible trigger stem 264 (FIG. 20). The trigger stem 264 is mounted on a trigger slide 256 and includes a, in the form of a protrusion on a bottom side. As can be seen in FIGS. 19 and 13, the trigger slide safety catch 258 is normally is positioned behind a trigger slide safety boss 260. The trigger slide safety boss 260 is fixed to the handles of the knife, and does not move relative to the knife. The trigger slide 256 is mounted for sliding movement relative to the trigger slide safety boss 260 and the knife.

In the normal position, shown in FIG. 18, the trigger slide safety boss 260 is positioned behind the trigger slide safety catch 258, and prevents movement of the trigger slide 256 rearward. As can be seen in FIG. 19, movement upward of the trigger button 254 (the flexibility of the flexible trigger stem 264 permits this movement) moves the trigger slide safety catch 258 upward so that it may move over the trigger slide safety boss 260. In this position, the user may slide the trigger button 254 rearward (right in FIG. 19) so that the trigger slide 256 moves rearward as well.

Details of the automatic opener are shown in FIGS. 14-16, and 21-22. The automatic opener includes a rocking sear 242 mounted on a fixed rocking sear pivot point 244. The fixed rocking sear pivot point 244 is attached to the knife so that the rocking sear can pivot about it, and in the embodiment shown in the drawings, includes two attachments, extending outward, so that a thrust arm 266, described below, can move freely between the two attachments. As can be seen in FIG. 16, the rocking sear is stamped to a U-shape (also so the thrust arm 266 can move through it), and includes a rocking sear roller 246 at an upper, rear portion, and a pair of rocking sear control studs 248 at a lower, front edge.

The thrust arm 266 is rigidly connected to a thrust arm pivot plate 268. As shown in FIG. 15, the thrust arm 266 can be a laminated three-layer structure, and the pivot plate 268 can be two plates attached on the outside of the thrust arm 266. Rivets 276 may be used to connect the layers together. A protrusion 271 is attached to the top of the pivot plate 268, and a notch 272 is formed in front the protrusion. The pivot plate 268 is shaped as a triangle, and is mounted for pivoting movement about a thrust arm assembly pivot point 278. The protrusion 271 and the thrust arm 266 are mounted on the other points of the triangle.

Figure 14:
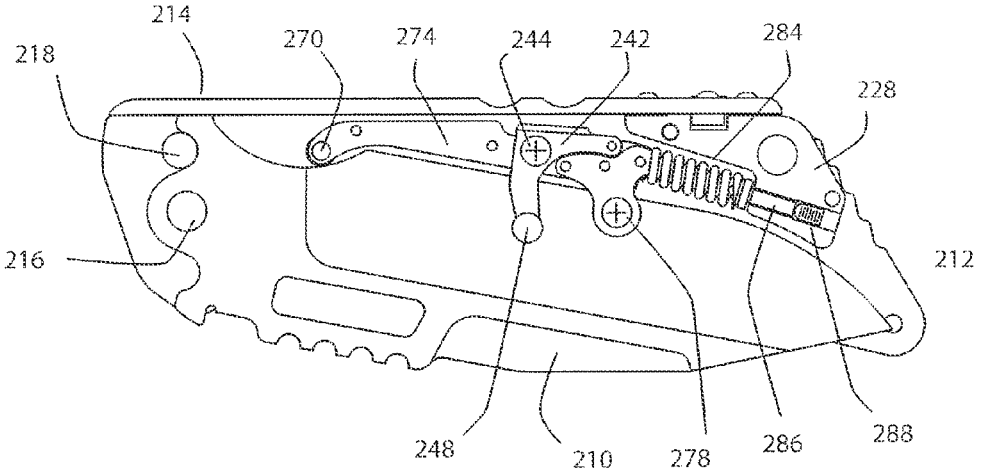
FIG. 14 shows same view as FIG. 12 but with top half of handle frame removed.

A thrust arm roller 270 is positioned on a leading end of the thrust arm 266. As can be seen in FIG. 14, the thrust arm roller 270 seats against a back edge of the knife tang. A main spring 284 (FIG. 21) is mounted behind the pivot plate 268. The main spring 284 is mounted on a main spring plunger 286 (FIG. 14) and biases the thrust arm roller 270 into rotation about the thrust arm assembly pivot point 278.

Figure 21:
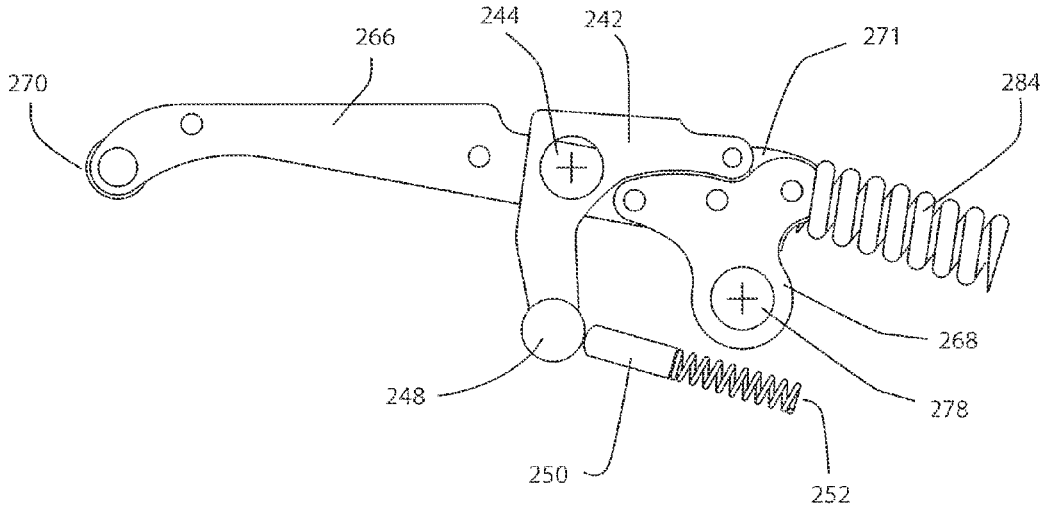
FIG. 21 shows the thrust arm and rocking sear of FIGS. 15 and 16 prior to firing.
Figure 22:
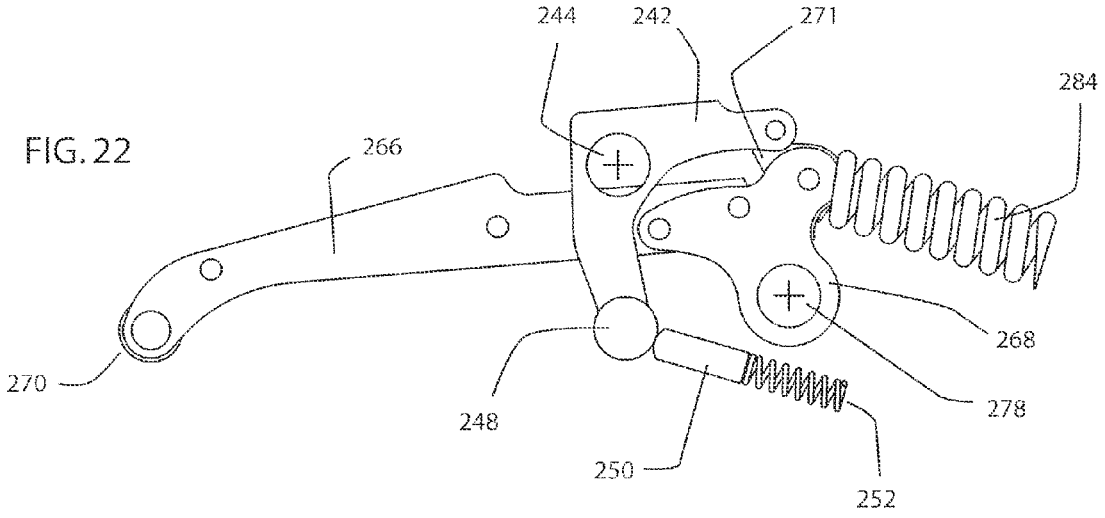
FIG. 22 shows the thrust arm and rocking sear of FIG. 21 after firing.

As can be seen in FIGS. 21 and 22, the rocking sear 242 mounts around the thrust arm 266, so that the top arm of the rocking sear is parallel to the thrust arm in a normal position. The rocking sear roller 246 fits into the notch 272, and prevents rotation of the thrust arm 266 against the bias of the main spring 284.

A rocking sear rebound spring 252 includes a rocking sear follower 250 mounted at an end. The rebound spring 252 biases the follower 250 into contact with the rocking sear control stud 248, biasing the rocking sear roller 246 into engagement with the notch 272. In this manner, under normal conditions, the rebound spring 252 prevents accidental engagement of the thrust arm 266.

As can be seen in FIGS. 18-20, the rear edge of the trigger slide 256 engages an opposite side of the rocking sear control stud 248.

When the trigger mechanism is in the normal position, the trigger button 254 is held in position by virtue of the resilient force applied by the flexible trigger stem 264 of trigger slide 256 being held in engagement with trigger slide safety boss 260 (FIG. 18). The rocking sear 242 is positioned behind the trigger slide 256 (also FIG. 18), as described above. The rocking sear roller 246 is lodged in the notch (FIG. 21), preventing actuation of the thrust arm 266.

To actuate the automatic opener, the trigger mechanism is first unlocked (taken out of safety) and then is actuated. To unlock the trigger mechanism, the trigger button 254 is lifted by thumb pressure in direction of arrow c, FIG. 12. At this point, the trigger slide safety catch 258 is moved from behind the trigger slide safety boss 260 (FIG. 19), permitting movement of the trigger slide 256 rearward. The thumb may then pull the trigger button 254 rearward in the direction of arrow d (FIG. 12). As the trigger slide 256 travels in the direction of arrow d, its engagement with rocking sear control stud 248, produces a counter clockwise rotation of the rocking sear 242, about rocking sear pivot point 244, overcoming the resilient loading of rocking sear rebound spring 252.

As the rocking sear 242 rotates, the rocking sear roller 246 disengages the notch 272 in the thrust arm 266, releasing the protrusion 271 and allowing the thrust arm 266 to rotate in a counterclockwise direction, in response to the release of energy stored in mainspring 284. As the thrust arm 266 rotates, the thrust arm roller 270 bears against the tang of the blade 210, which propels blade 210 to rotate about pivot point 216, to assume the open position as previously described. To perform a full automatic opening until the blade is locked, the mainspring 284 is of a spring tension that is sufficient to move the blade 210 past the strap lock. As described previously, such force is sufficient to freely rotate the blade to a fully opened, locked position.

Closing the blade 210 is as previously described. First the blade 210 is unlocked from the strap lock, and then the blade is rotated to a closed position. As the blade 210 is folded into handle frames 212, the tang of the blade 210 contacts the roller 270 of the thrust arm 266, returning thrust arm 266 to its cocked position against the pressure of main spring 284, allowing rocking sear 242 to reengage thrust arm sear notch 272 which is the beginning of the cycle prior to the next firing As can be readily understood by a careful analysis of the foregoing, embodiments herein offer multiple substantial improvements over the prior art. The configuration of the strap lock allows for a predetermined level of force to be restrained prior to firing which insures a successful opening cycle to lock. The strap lock being subject to the gripping force of the operator's hand, when used in the open blade position, contributes to the security of a locked open blade. The symmetrical configuration of the strap lock provides for completely ambidextrous delocking. The main spring 284 of the automatic opener can be adjustable for various power levels and the blade may be opened either manually or automatically by a trigger button with integral safety.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A knife, comprising:

a handle defining a front pocket and a back side;

a folding blade rotatably attached to the handle and rotatable between a first position where the blade is at least partially stored in the front pocket and a second, opened position where the blade is rotated out of the front pocket and an edge for the blade is exposed;

a strap lock mounted on the back side of the handle for locking the blade in the opened position; and an adjustment mechanism configured to permit adjustment of the strap lock so as to reduce slop when the blade is in the opened position.

2. The knife of claim 1, wherein:

the blade comprises a protrusion; and the strap lock comprises an interface, the interface locking behind the protrusion when the strap lock locks the blade in the opened position.

3. The knife of claim 2, wherein the knife comprises a distal end, at which the blade is rotatably mounted, and a proximal end, and wherein the strap lock is connected at the proximal end of the back side of the handle, and wherein the adjustment mechanism is configured to allow movement of the strap lock at least one of toward or away from the distal end.

4. The knife of claim 3, further comprising at least one fastener for connecting the strap lock to the handle, and wherein the adjustment mechanism comprises a structure that, when said at least one fastener is at least one of loosened or removed, is actuated to cause movement of the strap lock in said at least one of toward and away directions.

5. The knife of claim 4, wherein the structure comprises a fastener, and wherein at least one of tightening or loosening the fastener causes the strap lock to move in the away direction.

6. The knife of claim 5, wherein the strap lock comprises a first opening, and wherein the structure comprises a cam surface that engages an edge of the first opening when the fastener is at least one of tightened or loosened, the cam surface driving the strap lock in the away direction.

7. A method of adjusting the connection of a knife blade and a strap lock on a folding knife, comprising:

loosening the connection of a strap lock to a handle for the knife, the strap lock configured to connect to a blade for the knife and to lock the blade into an opened position;

actuating an adjustment mechanism to move the strap lock in a direction to eliminate slop between a connection of the strap lock and the blade when the blade is in the opened position;

tightening the fasteners to maintain the new position of the strap lock.

8. The method of claim 7, wherein said actuating act occurs while the blade is the opened position.

9. The method of claim 7, wherein actuating comprises rotating a fastener to drive a cam into engagement with the strap lock, the cam moving the strap lock as a result of the engagement.

10. The method of claim 7, wherein loosening and tightening comprises loosening and tightening of at least one fastener that fixes the strap lock to the handle.

11. A knife, comprising:

a handle defining a front pocket and a back side;

a folding blade rotatably attached to the handle and rotatable between a first position where the blade is at least partially stored in the front pocket and a second, opened position where the blade is rotated out of the front pocket and an edge for the blade is exposed; and a strap lock mounted on the back side of the handle for locking the blade in the opened position, the strap lock being biased towards the handle;

the blade comprising:

a flipper that extends out of a back side of the handle when the blade is in the first position;

a first surface for connecting to the strap lock when the knife is in the first position and biasing the knife into the first position; and a second surface for connecting to the strap lock when the knife is the opened position and locking the knife into the opened position.

12. The knife of claim 11, wherein the bias of the strap lock to the first surface creates a resistance to rotation of the blade by a user via the flipper, and wherein the resistance is sufficient that, once the resistance is overcome, the blade rotates at sufficient momentum to lock the blade via the second surface.

13. The knife of claim 12, wherein the flipper extends through an opening in the strap lock.

14. The knife of claim 13, wherein the first surface engages an interface on the strap lock adjacent the opening to bias the blade to the first position.

15. The knife of claim 14, wherein the second surface engages a second interface on the strap lock to lock the blade into the opened position, the second interface comprising an outer edge of the opening.

16. The knife of claim 13, wherein the second surface engages an interface on the strap lock to lock the blade into the opened position, the interface comprising an outer edge of the opening.

17. The knife of claim 12, wherein the flipper extends through an opening in the strap lock.

18. The knife of claim 17, wherein the first surface engages an interface on the strap lock adjacent the opening to bias the blade to the first position.

19. The knife of claim 18, wherein the second surface engages a second interface on the strap lock to lock the blade into the opened position, the second interface comprising an outer edge of the opening.

20. The knife of claim 17, wherein the second surface engages an interface on the strap lock to lock the blade into the opened position, the interface comprising an outer edge of the opening.

21. The knife of claim 17, further comprising an automatic opener configured to rotate the blade from the first position to the second position, the automatic opener supplying sufficient force to overcome the resistance and to move the blade fully to the opened position.

22. The knife of claim 21, wherein the automatic opener comprises a thumb actuator that releases a safety on a first actuation and fully opens the knife on a second actuation.

23. The knife of claim 22, wherein the first actuation comprises movement in a first direction, and the second actuation comprises movement in a second direction.

24. The knife of claim 12, further comprising an automatic opener configured to rotate the blade from the first position to the second position, the automatic opener supplying sufficient force to overcome the resistance and to move the blade fully to the opened position.

25. The knife of claim 24, wherein the automatic opener comprises a thumb actuator that releases a safety on a first actuation and fully opens the knife on a second actuation.

26. The knife of claim 25, wherein the first actuation comprises movement in a first direction, and the second actuation comprises movement in a second direction.

27. The knife of claim 11, further comprising an automatic opener configured to rotate the blade from the first position to the second position, the automatic opener supplying sufficient force move the blade fully to the opened position.

28. The knife of claim 27, wherein the automatic opener comprises a thumb actuator that releases a safety on a first actuation and fully opens the knife on a second actuation.

29. The knife of claim 28, wherein the first actuation comprises movement in a first direction, and the second actuation comprises movement in a second direction.

* * * * *